United States Patent [19]

Tsuneta et al.

[11] 4,135,113

[45] Jan. 16, 1979

[54] LINE-TYPE PICTURE TUBE WITH LIGHT-ABSORBING PARTICLES MIXED WITH BLUE PHOSPHOR

[75] Inventors: Asahide Tsuneta, Kawasaki; Yasuo Ohta, Fukaya; Makoto Ikegaki, Yokohama; Takeo Ito, Fukaya, all of Japan

[73] Assignee: Tokyo Shibaura Electric Co., Ltd., Kawasaki, Japan

[21] Appl. No.: 775,367

[22] Filed: Mar. 7, 1977

[30] Foreign Application Priority Data

Mar. 8, 1976 [JP] Japan ..... 51-24227

[51] Int. Cl.[2] ..... H01J 29/30; H01J 29/28

[52] U.S. Cl. ..... 313/470; 313/474

[58] Field of Search ..... 313/461, 467, 470, 472, 313/474

[56] References Cited

U.S. PATENT DOCUMENTS

| | | | |
|---|---|---|---|
| 2,634,217 | 4/1953 | Sanabria et al. | 313/474 X |
| 3,365,292 | 1/1968 | Fiore et al. | 313/467 X |
| 3,569,761 | 3/1971 | Lange | 313/408 |
| 3,748,515 | 7/1973 | Kaplan | 313/474 X |
| 3,812,394 | 5/1974 | Kaplan | 313/472 X |

*Primary Examiner*—Robert Segal

*Attorney, Agent, or Firm*—Cushman, Darby & Cushman

[57] ABSTRACT

A color picture tube in which at least one of phosphor layers emitting green, blue and red lights which are deposited on the inner surface of a glass panel contains a black light-absorbing material.

1 Claim, 9 Drawing Figures

LINE-TYPE PICTURE TUBE WITH LIGHT-ABSORBING PARTICLES MIXED WITH BLUE PHOSPHOR

This invention relates to a color picture tube capable of presenting an image of high contrast.

Hitherto, various processes have been proposed and put to practical application to improve the contrast of a color image appearing on a color picture tube placed in a bright ambient light.

A color picture tube comprises phosphor layers emitting green, blue and red light when electron beam impinge thereon. To increase the contrast of a color image, there has been adopted a process of reducing the light permeability of a glass panel in order to reduce the effect of an ambient light on a phosphor layer. Hitherto, a demand to improve the contrast of a color image has been satisfied by manufacturing panel glass containing an extremely minute amount of a coloring agent, for example, cobalt oxide, thereby providing a grey panel, a semitint panel and a tint panel. The different degrees of light permeability of these panels indicate about 65%, about 55% and about 45% respectively, as against about 85% light permeability of the so-called clear glass panel.

The above-mentioned coloring agent-containing glass panel is indeed effective to increase the contrast of a color image, but is accompanied with the drawback that the brightness of a color image is lost by the extent to which the glass panel decreases in light permeability.

Another method of improving the contrast of a color image is to provide a plurality of spatially arranged black nonluminescent layers between a glass panel and phosphor layers. These black nonluminescent layers absorb an ambient light introduced through the glass panel, thereby improving the contrast of a color image.

With a color picture tube, the light-emitting section of a phosphor screen is generally restricted to about 60 to 70% of the whole area of said screen in order to preserve the purity of colors of a color image, with the remaining 40 to 30% of the screen area constituted by a nonluminescent section. This arrangement is intended to suppress the emission of undesired colored lights even when color selection is carried out with some errors. Provision of the aforesaid black nonluminescent layers in the non-light emitting section of the prior art phosphor screen would indeed increase the contrast of a color image without losing its brightness at all. The recent tendency, however, goes toward a demand for a more improved contrast of a color image rather than for an increase in its brightness. It may be contemplated to increase an area occupied by black nonluminescent layers on a phosphor screen to 50 to 60% in order to enable a color image to have a more distinct contrast. In this case, however, the light-emitting section of a phosphor screen would be conversely reduced in an area, making it necessary to design dots or stripes acting as light-emitting elements to have a smaller diameter and width, whereby subjecting the technique of manufacturing a fluorescent plane to more limitations.

It is accordingly the object of this invention to provide a color picture tube which is free from the drawbacks accompanying the conventional means for increasing the contrast of a color image and enables a color image to have a more distinct contrast by means of a simple device.

To this end, this invention provides a color picture tube in which phosphor layers emitting green, blue and red colors are provided on the inner surface of a glass panel, and any one of these layers contains a black light-absorbing material. As the result, the color picture tube of this invention absorbs those portions of an ambient light introduced through a glass panel which harmfully affect the contrast of a color image, thereby improving said contrast and moreover can be easily manufactured without losing the brightness of the color image.

This invention can be more fully understood from the following detailed description when taken in conjunction with the accompanying drawings.

Figure 5:
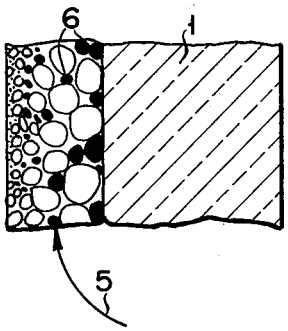
Figure 6:
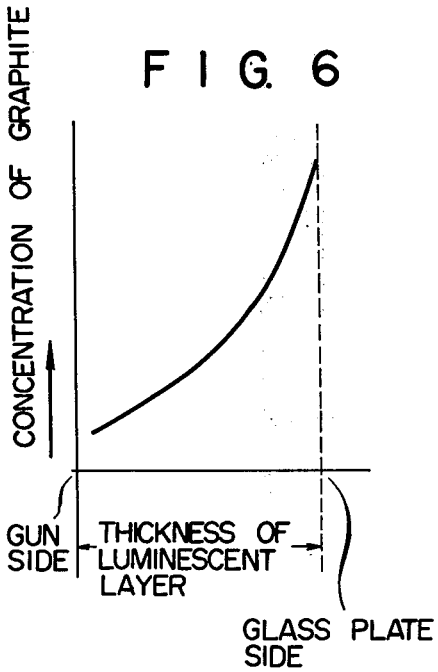

FIG. 5 indicates how particles a black light-absorbing material are distributed in a phosphor layer; and FIG. 6 shows the concentration of the black light-absorbing material in a phosphor layer of this invention.

There will now be described by reference to the appended drawings a color picture tube embodying this invention.

Figure 1:
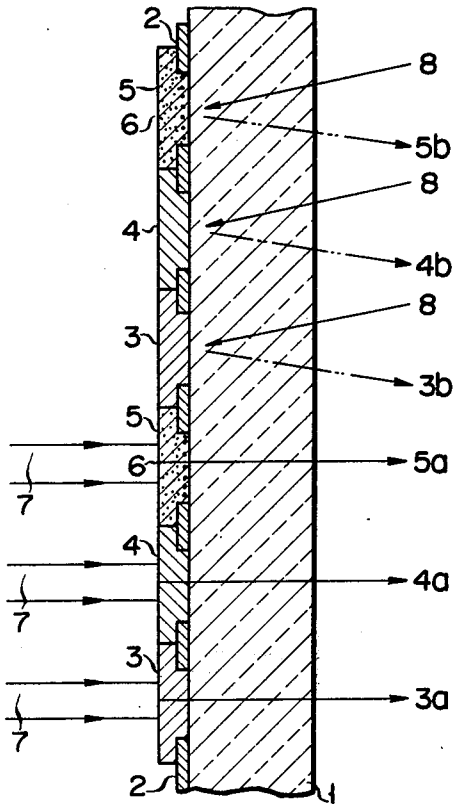
FIG. 1 is a fractional sectional view of a color picture tube embodying this invention.

Referring to FIG. 1, a plurality of black nonluminescent layers 2 are spatially formed on the inner surface of a glass panel 1. A plurality of groups consisting of a red phosphor layer 3, green phosphor layer 4 and blue phosphor layer 5 arranged parallel in the same order are formed on the inner surface of the glass panel 1 with the black nonluminescent layers 2 laid between said phosphor layers and the inner surface of the glass panel 1. In the foregoing embodiment, the blue phosphor layers 5 alone contain black light-absorbing particles 6, for example, graphite particles. With a phosphor screen constructed as described above, introduced electron beams 7 cause the red phosphor layers 3, green phosphor layers 4 and blue phosphor layers 5 to emit a red light **3*a*, green light 4*a*, and blue light 5*a* respectively in the direction of the indicated arrows. On the other hand, an ambient light 8 is brought in through the glass panel 1 to the phosphor layers 3, 4, 5, is reflected from the surface thereof, and returned to the outside through the glass panel 1 in the form of reflections 3*b*, 4*b*, 5*b*. If rendered unduly bright, the reflections 3*b*, 4*b*, 5*b* give rise to a decline in the contrast of a color image. With this embodiment, however, not only the black nonluminescent layers 2 but also black light absorbing particles 6 contained in the blue phosphor layers 5 absorb an ambient light 8 to decrease reflections from the whole phosphor screen 1** with the resultant increase in the contrast of a color image.

It has been experimentally proved that with the color picture tube of this invention, the contrast of a color image is remarkably improved and moreover a standard white brightness of a color image resulting from the composition of red, green and blue lights is only slightly reduced. The brightness of a color pictube tube is generally judged by the amount of the sum of three electron gun currents when the image is above mentioned white. There will be described the operation of a color picture tube embodying invention by reference to an experiment. A color picture tube used in the experiment comprised of a red phosphor layer made of $Y_2O_2S$:Eu, green phosphor layer made of ZnS:Cu, Al, all formed on the surface of the glass panel 1. The color picture tube were tested under the following specified conditions: a color temperature of standard white of 9300° K +27 M.P.CD, brightness thereof of 32 FL and the acceleration voltage of electron beams of 25 KV. Under the above-mentioned conditions, the standard white brightness of the color image appears when a red gun is supplied with current Ir=92 μA, a green gun with current Ig=98 μA and gun with current Ib=70 μA, that is, a total amount of current introduced indicates WIb=260 μA. As seen from the amounts of current passing through the red-, green- and blue- guns, it is possible to increase the current Ib of the blue gun over the currents Ir and Ig of the red- and green- guns. This is because a blue phosphor layer withstands an increase in an amount of current to be introduced through said layer. This also means that the current Ir of the red gun can be increased, though slightly, up to the level of the current Ig of the green gun.

The reason why the blue phosphor layer 5 is made to contain black light-absorbing particles is that though the current Ib of the blue gun has to be increased to compensate for a fall in the brightness of the blue phosphor layer 5 resulting from the inclusion of black light-absorbing particles, yet the current Ib of the blue gun still has margin for increase, as previously described, that is, the blue phosphor layer 5 is most adapted for current increase.

Experiments were made to find the extent to which the brightness of the standard white decreased when the luminosity of the blue phosphor layer 5 was progressively reduced with the content of black light-absorbing particles varied under the condition in which the electron beam-accelerating voltage was set at 25KV and the brightness of the color image at 30FL. The results of the experiment are set forth in Table 1.

Table 1

| Luminosity of a blue phosphor layer | −5% | −10% | −15% | −20% | −25% | −30% |
|---|---|---|---|---|---|---|
| W Ib (μA) | 257 | 254 | 251 | 247 | 244 | 240 |
| Brightness | −1.0% | −2.4% | −3.6% | −5% | −6.3% | −7.6% |

Table 1 shows that even when the blue phosphor layer 5 reduces in a luminosity, the brightness of the standard white only slightly decreases, namely, that where black-absorbing particles are included in the blue phosphor layer 5 alone, the contrast of a color image can be improved with the brightness of the above-mentioned standard white maintained at a practically sufficient level.

There will can be described the results of numerically discussing the above-mentioned fact from a different point of view.

First, study is made of the relationship of the reflectivity of an ambient light on a color screen corresponding to a weight (%) of black light-absorbing particles contained in the blue phosphor layer and the resultant brightness of the phosphor screen.

Figure 3:
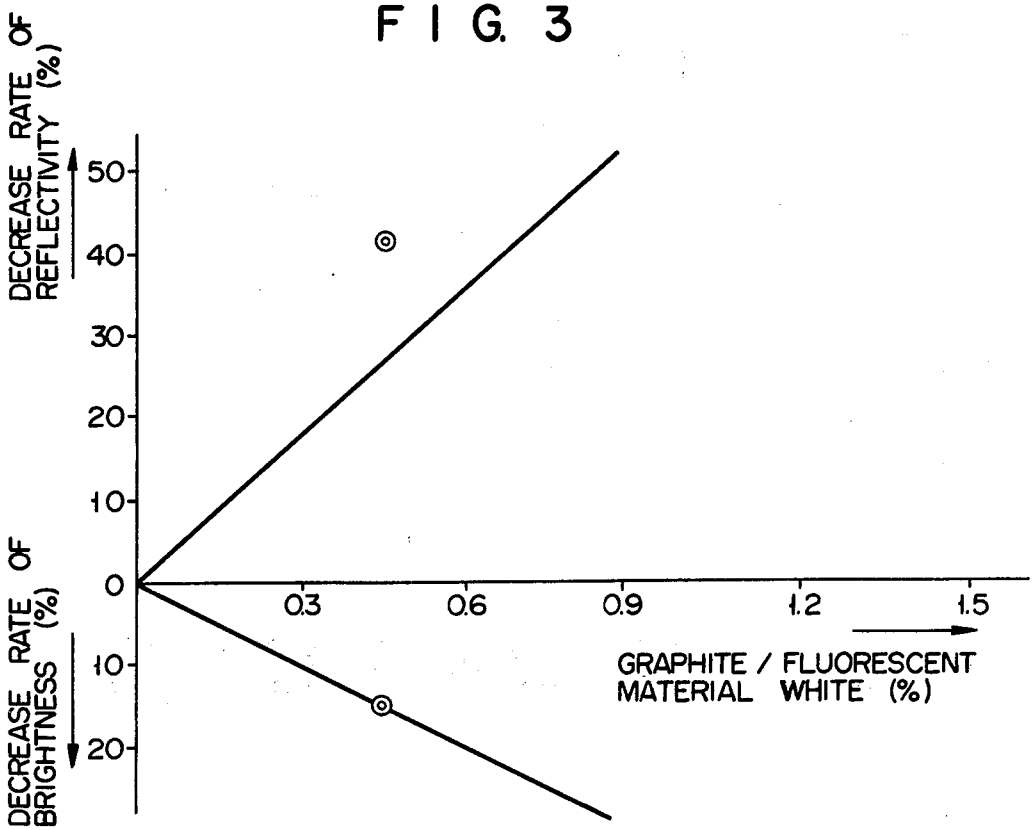
FIG. 3 shows the relationship of a weight (%) of a black light-absorbing material contained in a phosphor layer to a decline in the reflectivity of an ambient light in the screen of the color picture tube as well as in the brightness of said screen.
Figure 2:
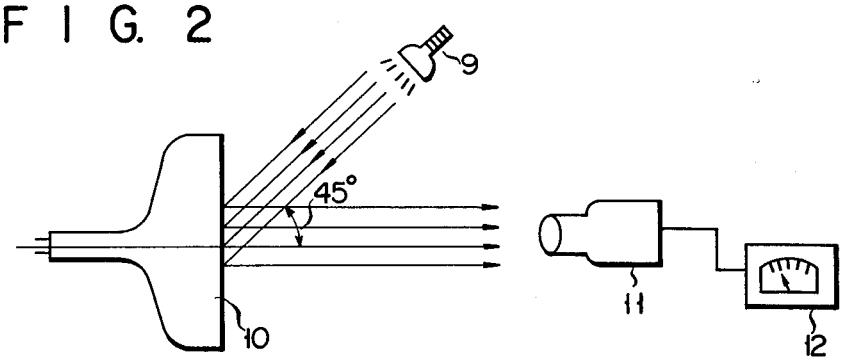
FIG. 2 illustrates a device for measuring the reflectivity of an ambient light on the screen of the color picture tube.

The reflectivity of an ambient light on a phosphor screen was measured by a device shown in FIG. 2. A white light from a white light source 9 having a specified brightness was projected on an inner surface of a glass panel of a color picture tube 10 at an angle of about 45° as indicated by the arrows. The brightness of reflections was detected by a Prichard photometer 11 to be read on a meter 12. The black light-absorbing particles were graphite. Measurement was made by the device of FIG. 2 of the reflectivity of an ambient light on a phosphor screen corresponding to the weight (%) of the graphite contained in the blue phosphor layer. FIG. 3 is a graphic representation of a decrease rate in the reflectivity of an ambient light and the resultant brightness of the screen. Solid lines of FIG. 3 denote the reflectivity of an ambient light on a glass panel having a light permeability of 85%, with a total area of black nonlumilescent layers 2 chosen to have a ratio of 30% to the whole area of the screen. Referring to FIG. 3, a ratio of zero between the weight of graphite and that of the blue phosphor represents a prior art color picture tube. Double circles indicate a decline (%) in the reflectivity of an ambient light as well as in the resultant brightness of the screen as measured with a gray panel having a light permeability of 64%. The graph of FIG. 3 shows that where the weight of grahite had a ratio of 0.45% to that of the blue phosphor, than the brightness of the screen decreased to an extent of about 15%, whether the panel was a clear or gray type. Under the above-mentioned brightness of the screen, the reflectivity of an ambient light even on the clear panel showed a decrease of 27%, though this decrease rate was smaller than a 43%, decline in the reflectivity of an ambient light on the gray panel. As mentioned above, proper selection of the ratio of the weight of black light-absorbing particles to that of the blue phosphor enables the relationship of the brightness of the screen and the reflectivity of an ambient light thereon, that is, the contrast of a color image to be freely chosen.

There will now be described by reference to FIGS. 4A to 4D a method of manufacturing a screen with black light-absorbing particles 6 contained in a blue phosphor layer 5.

Figure 4A:
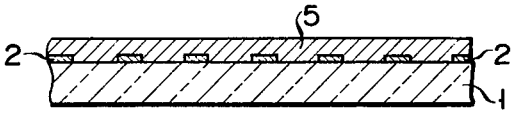
FIGS. 4A–4D show the sequential steps of manufacturing the screen of a color picture tube according to this invention.
Figure 4B:
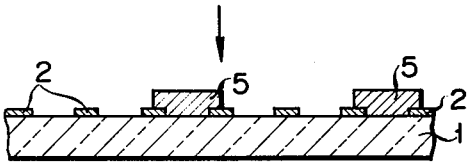
Figure 4C:
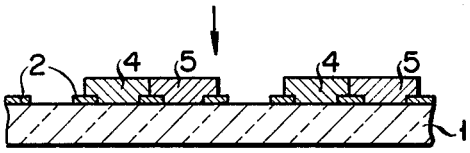
Figure 4D:
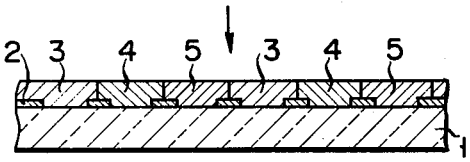

First, a batch of black light-absorbing particles 6 of for example, Aquadag or manganese dioxide, 60 to 80% of which is constituted by phase less than 3 microns in diameter is mixed in a desired ratio with another batch of similar black light-absorbing particles 6, 60 to 80 of which is formed of phase 4 to 6 microns in diameter. Both mixture of black light-absorbing particles 6, together with a surfactant, are put in distilled water, followed by milling. The milled black light-absorbing particles are dissolved in the distilled water. Later, a sensitizer, for example, polyvinyl alcohol is added to the solution. After stirred, the solution of the whole mixture is poured in a slurry of a blue phosphor material at the rate of 0.1 to 3% by weight based on that of said phosphor the resultant solution is uniformly coated thin, as shown in FIG. 4A, in the inner surface of the glass panel 1 on which black nonluminescent layers 2 are already spatially formed, by rotating said glass panel 1. This rotary coating process causes the slurry of the blue phosphor material now mixed with the dispersion of the black light-absorbing particles 6 to be spread over the inner surface of the glass panel 1.

When the glass panel is slowly rotated for a prescribed length of times, then larger ones of the black light-absorbing particles 6 settle down on the inner surface of the glass panel 1. On the other hand, smaller ones of the black light-absorbing particles 6 are left on that side of the fluorescent plane on which electron beams impinge. After a required length of time for the larger particles fully settle down to the inner surface of the glass panel 1, the glass panel 1 is again rotated rapidly centrifugally to throw off those portions of the above-mentioned solution which flow out on the inner surface of the glass panel 1, thereby causing a blue phosphor layer to be formed uniformly thin on the inner surface of the glass panel 1. The slurry of the blue phosphor is referred to have a viscosity, which, as measured by the #4 For Cup is indicated by 30 to 35 seconds required for the slurry to fall off through a hole having a prescribed diameter. Since the settling speed of the particles of a black light-absorbing material contained in the blue phosphor varies with the particles size of said blue phosphor, the viscosity of the slurry of the blue phosphor should be determined in consideration of the particle size of said blue phosphor. After dried, a blue phosphor layer thus formed is exposed to ultraviolet rays emitted from, for example, a mercury lamp through a shadow mask to provide a prescribed pattern in said layer.

Thereafter, the blue phosphor layer 5 is sprayed with dilute ammonia water for a prescribed length of time to decompose a sensitized polyvinyl alcohol created on the phosphor layer 5 and also to dissolve out the particles of lying near the innerside of phosphor layer 5. Next, the fluorescent layer 5 is sprayed with hot water to wash off the particles lying mean the innerside of the phosphor layer 5, and, as the result, is shaped into the form shown in FIG. 4B. In this case, care should be taken to prevent the dilute ammonia water from being sprayed too excessive with the resultant dissolution of the particles contained in the phosphor layer itself 5. The green phosphor layer 4 and red phosphor layer 3 are formed through the same steps as used with the blue phosphor layer 5 with the resultant shape shown in FIGS. 4C and 4D respectively.

When the blue phosphor layer 5 was observed in a magnified state by, for example, an electronic microscope and X-ray micro analyzer, it was found that as shown in the sectional view of FIG. 5, numerous larger black light-absorbing particles were formed near the inner surface of the glass panel 1 with a higher density, whereas smaller black light-absorbing particles were formed with a progressively lower density toward first side of the glass panel 1 which faced an electron gun. The density of the black light-absorbing particles are distributed as graphically shown in FIG. 6. It has been proved that with the color picture tube of this invention, the contrast of a color image can be prominently improved relative to a decline in its brightness. Where the blue, red and green phosphor layers have the previously mentioned chemical compositions, then inclusion of black light-absorbing particles in the blue phosphor layer 5 has been formed effective to render the contrast of a color image more distinct under the condition in which the current Ir of the red gun bears a ratio of 0.4 to the current Ib of the blue gun. However, inclusion of the black light-absorbing particles 6 only in the red phosphor layer has also been shown to be effective to improve the contrast of a color image, from the ratio between the current Ir of the red gun and the current Ig of the green gun or the ratio between the current Ir of the red gun and the current Ib of the blue gun which is defined in case the green phosphor layer has a chemical composition of ZnSCdS:CuAl, as well as when the color temperature is set at 6500° K+7 M.P.CD.

For the object of this invention, black light-absorbing particles need not be included in the blue phosphor layer alone. But the chemical composition of a fluorescent layer which should contain black light-absorbing particles may be freely chosen, according to the selected chemical compositions of the other two phosphor layers, the prescribed ratio which the cathode currents of the three phosphor layers bear to each other in order to provide a proper white section for a color image and the color temperature of a color picture tube used.

The foregoing description refers to the case whose graphite was used as black light-absorbing material. However, partial substitution of pigment for the graphite is also effective to increase the contrast of a color image. Further, the above-mentioned embodiment comprised a screen provided by forming black nonluminescent layers on the inner surface of the glass panel. Obviously, it is possible to use a screen free from said black nonluminescent layers.

What we claimed is:

1. A color picture tube which comprises a glass panel;

a plurality of groups consisting of green, blue and red phosphor strips on the inner surface of said glass panel;

black nonluminescent strips laid between said phosphor strips and the inner surface of said glass panel;

and wherein said blue phosphor strip contains 0.1% to 3.0% by weight of black light-absorbing particles based on the weight of said phosphor dispersed throughout the strip for reducing reflection.

* * * * *